US008621966B2

(12) United States Patent
Germaine et al.

(10) Patent No.: US 8,621,966 B2
(45) Date of Patent: Jan. 7, 2014

(54) PERFORATION ANVIL

(75) Inventors: Andrew Germaine, Ruston Parva (GB); Michael Jay Haasl, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1253 days.

(21) Appl. No.: 12/077,399

(22) Filed: Mar. 18, 2008

(65) Prior Publication Data

US 2009/0235800 A1 Sep. 24, 2009

(51) Int. Cl.
*B26D 1/00* (2006.01)
*B26D 7/20* (2006.01)

(52) U.S. Cl.
USPC ..... 83/13; 83/34; 83/659; 83/347

(58) Field of Classification Search
USPC ..... 83/659, 346, 658, 663, 347, 916, 693, 83/698.41, 13, 34; 408/71; 493/428, 432
See application file for complete search history.

(56) References Cited

U.S. PATENT DOCUMENTS

| | | | | | |
|---|---|---|---|---|---|
| 1,653,589 | A | * | 12/1927 | Ross | 414/615 |
| 1,693,589 | A | * | 12/1928 | Bolton | 83/342 |
| 3,073,196 | A | | 1/1963 | Marcalus | |
| 3,086,416 | A | * | 4/1963 | Minarik | 83/345 |
| 3,835,754 | A | | 9/1974 | Lewyckyj | |
| 3,857,314 | A | * | 12/1974 | Gregoire | 83/346 |
| 4,698,052 | A | | 10/1987 | Slobodkin | |
| 4,737,393 | A | | 4/1988 | Linkous | |
| 4,842,794 | A | * | 6/1989 | Hovis et al. | 264/145 |
| 5,313,863 | A | * | 5/1994 | Aihara et al. | 83/171 |
| 5,327,806 | A | * | 7/1994 | Houser | 83/636 |
| 5,351,397 | A | * | 10/1994 | Angeli | 29/890.053 |
| 5,375,751 | A | | 12/1994 | Makinen | |
| 5,562,964 | A | | 10/1996 | Jones | |
| 5,695,105 | A | * | 12/1997 | Ohara | 225/96 |
| 6,089,438 | A | | 7/2000 | Suzuki et al. | |
| 6,523,595 | B1 | | 2/2003 | Milner et al. | |
| 6,604,444 | B1 | * | 8/2003 | Belanger et al. | 83/155 |
| 6,838,040 | B2 | | 1/2005 | Mlinar et al. | |
| 6,913,673 | B2 | | 7/2005 | Baggot et al. | |
| 6,971,295 | B2 | * | 12/2005 | Teshima | 83/162 |
| 7,007,580 | B2 | * | 3/2006 | Hilliard et al. | 83/346 |
| 2003/0000357 | A1 | * | 1/2003 | Tanaka | 83/37 |
| 2007/0144324 | A1 | * | 6/2007 | Robert et al. | 83/659 |

FOREIGN PATENT DOCUMENTS

DE 103 56 037 A1 7/2005

* cited by examiner

*Primary Examiner* — Omar Flores Sanchez
(74) *Attorney, Agent, or Firm* — David J. Arteman; Randall W. Fieldhack; Sarah Ann Dressel

(57) ABSTRACT

A method and apparatus for perforating a web includes an anvil roll having an outer surface wherein at least a portion of the outer surface defines an anvil surface. The anvil surface includes a plurality of angled grooves having a variable groove width. The method may include phasing the cutting position on the anvil to effect varying perforation patterns.

14 Claims, 5 Drawing Sheets

PERFORATION ANVIL

BACKGROUND OF THE INVENTION

The present invention relates generally to a method and apparatus for perforating a web in the cross machine direction. Additionally, the present invention relates generally to a method and apparatus for perforating a web in the cross-machine direction wherein the web includes elastic members extending in a machine direction.

In conventional perforating methods, a line of perforations is formed by cutting or punching through a web at spaced intervals to form a line of discontinuous cuts defined by cut segments separated by uncut regions. Conventional perforating is frequently undertaken with a standard knife and anvil system wherein the knife includes a plurality of notches in the cutting edge that corresponded to the uncut regions in the line of discontinuous cuts. In conventional perforating methods, changing the relative density and/or size of the cut segments and/or the uncut regions requires obtaining new knives having notches of the appropriate size and spacing to create the desired new pattern. Additionally, in conventional systems, as old knives become dull, new knives must be modified with the appropriate notch sizes and spacing to create the desired pattern.

Furthermore, conventional perforating methods are not optimal for perforating webs with elastic members or other reinforcing members extending in the machine direction because the elastics disposed in the cut segments are cut and the elastics disposed in the uncut regions remain whole and thus retain their strength. This provides an impediment to separation of the web along the line of perforation.

Furthermore, inherent variability in the cross-directional tracking of the web and cross-directional placement of the elastics results in a varying number of elastics being cut at various times. As such, the force required to break the web at the line of perforation also varies over time and causes difficulties in processing.

Therefore, there exists a need for a method and apparatus for perforating a web wherein the perforation pattern can be changed without changing the knife. There also exists a need for a method and apparatus for perforating a web wherein the knives do not need to be altered to achieve the desired perforation pattern. Finally, there exists a need for a method and apparatus for perforating a web having elastic members extending in the machine direction wherein each of the elastic members are consistently cut or damaged.

SUMMARY OF THE INVENTION

In one aspect, the present invention provides an anvil roll. The anvil roll includes an anvil surface having a plurality of grooves. The grooves have a variable cross-machine direction groove width. In some embodiments, the plurality of grooves may be angled. In some embodiments, the anvil surface may be part of an insert. In some embodiments, the anvil surface may be made of cobalt sub-micron HIP carbide. In some embodiments, the anvil surface may have a radius in the machine direction of 6 to 12 inches. In some embodiments, the cross-machine direction groove width may vary from about 0.015 inches to about 0.006 inches. In some embodiments, the grooves may be spaced apart by about 0.1 inches as measured in the machine direction. In some embodiments, the grooves may be spaced apart by about 0.160 inches as measured in the cross machine direction. In some embodiments, the grooves may have a groove angle of about 25 degrees to 45 degrees. In some embodiments, a majority of the grooves may have a straight edge taper.

In a particular embodiment, the plurality of grooves may be angled, the anvil surface may be part of an insert, the grooves may have a groove angle of 25 to 45 degrees, and the grooves may have a straight edge taper.

In another aspect, the present invention provides a perforation apparatus. The apparatus includes a knife roll, an anvil roll, and a cutting nip. The knife roll is adapted to be rotated about a knife roll axis. The knife roll includes at least one cutting edge. The anvil roll is adapted to be rotated about an anvil roll axis. The anvil roll axis is parallel with the knife roll axis. The anvil roll has an outer surface wherein at least a portion of the outer surface defines an anvil surface. The anvil surface includes a plurality of angled grooves. The cutting nip is defined by the point wherein the cutting edge contacts the anvil surface.

In various embodiments, the cutting edge may be continuous. In some embodiments, the cutting edge may be aligned parallel with the knife roll axis. In some embodiments, a majority of the grooves may have a variable groove width. In some embodiments, the majority of the grooves may have a straight edge taper.

In another aspect, the present invention provides a method of perforating a web. The method includes providing a web, passing the web through a nip, and perforating the web. The nip is defined as a contact point between a cutting edge and an anvil surface. The cutting edge includes a portion of a knife roll and the anvil surface includes a portion of an anvil roll. The anvil roll is adapted to rotate about an anvil roll axis and the knife roll is adapted to rotate about a knife roll axis. The anvil surface includes a plurality of grooves separated by a plurality of lands, the plurality of grooves being angled and having variable groove widths. The step of perforating the web in the nip at a first machine direction cutting position includes pressing the cutting edge against the web and the anvil surface to cut the web at the lands and to maintain the web at the grooves.

In various embodiments, the method may also include phasing the cutting edge relative to the anvil surface to perforate the web at a second machine direction cutting position wherein the grooves have a first width at the first machine direction cutting position and have a different second width at the second machine direction cutting position. In various embodiments, the web may include a carrier and a plurality of elastic strands extending in a machine direction and the method may further include perforating the web in a cross-machine direction by cutting or damaging all the strands of elastic and maintaining portions of the carrier as connectors. In some embodiments, the method includes aligning the elastic strands over the lands in the nip.

DETAILED DESCRIPTION OF THE DRAWINGS

The present invention provides a grooved anvil that may be used in conjunction with a cutting edge in a pinch cut operation to perforate a web. The web may include one or more elastics extending in the machine direction. The grooves in the anvil may be positioned at an angle relative to the machine direction such that an elastic running in the machine direction would be less likely to align with the groove in the anvil and more likely to be cut or damaged.

In some embodiments, the present invention provides a grooved anvil that may be used in conjunction with a pinch cut knife to perforate a web and the grooves may be tapered so that the uncut portion of the web can be adjusted by changing the position wherein the knife hits the anvil (i.e., the machine direction cutting position). This allows fine-tuning of the perforation pattern to suit various materials, process conditions, and/or grade changes.

Figure 1:
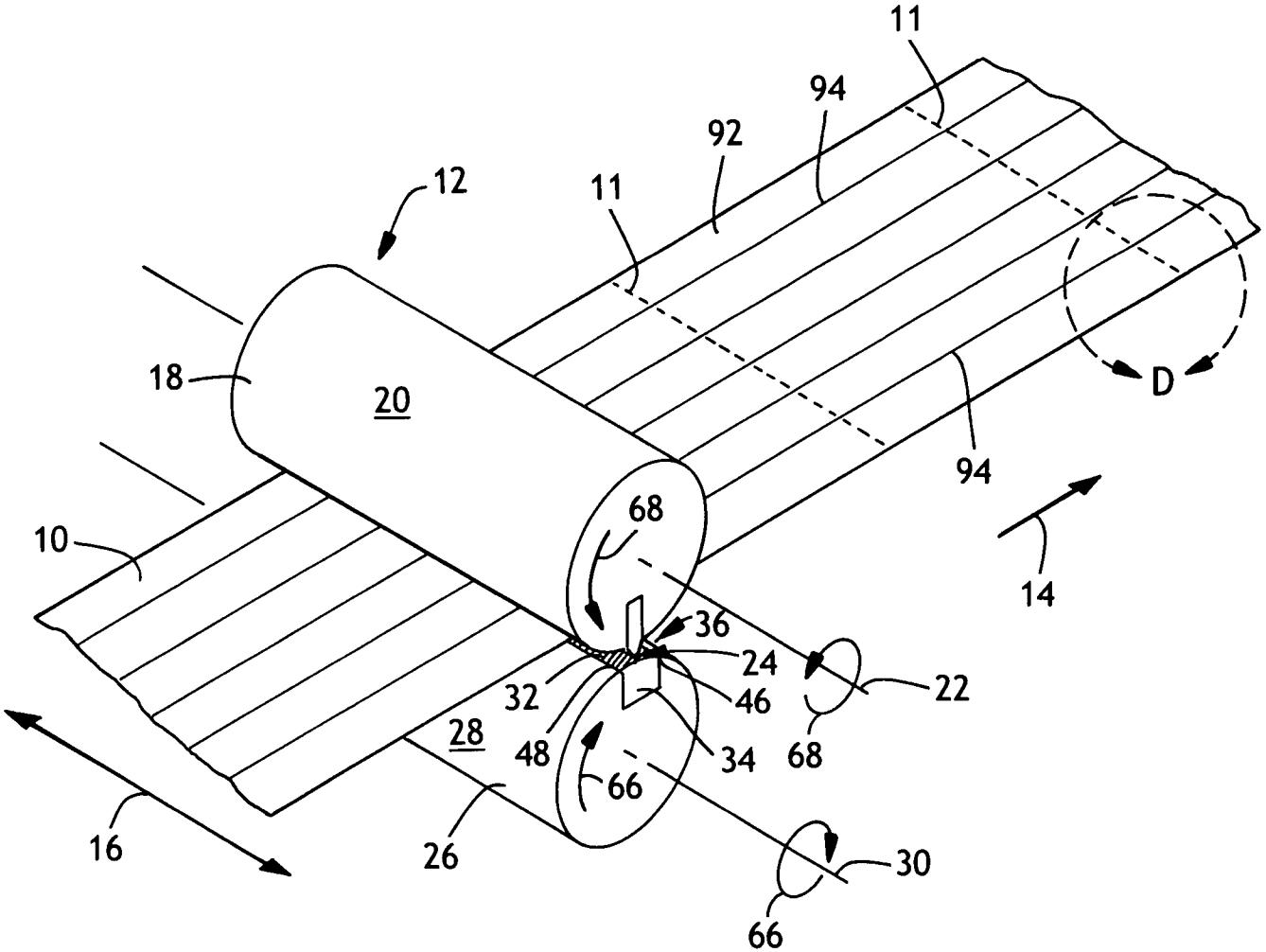
FIG. 1 representatively illustrates a perspective view of an exemplary embodiment of a method and an apparatus of the present invention.

Referring now to FIG. 1, a web 10 and a perforation apparatus 12 are illustrated in a perspective view. The web 10 is illustrated as moving in a machine direction 14. The web 10 passes through the perforation apparatus 12 resulting in a perforation 11 that extends generally in a cross-machine direction 16. The cross-machine direction is defined as the direction perpendicular to the machine direction 14.

The perforation apparatus 12 includes a rotatable knife roll 18. The rotatable knife roll 18 has a knife roll outer surface 20 and may be adapted to rotate about a knife roll axis 22. The outer surface 20 of the rotatable knife roll 18 includes at least one cutting edge 24. In some embodiments, and as illustrated in FIG. 1, the knife roll axis 22 may be parallel with the cross machine direction 16.

The perforation apparatus 12 also includes a rotatable anvil roll 26. The rotatable anvil roll 26 has an anvil roll outer surface 28 and may be adapted to rotate about an anvil roll axis 30. At least a portion of the outer surface 28 of the anvil roll 26 defines an anvil surface 32. In some embodiments, the anvil surface 32 may be an integral portion of the outer surface 28 of the anvil roll 26. For example, the entire outer surface 28 of the anvil roll 26 may be hardened to function as the anvil surface 32. This arrangement would not require phasing as the cutting edge could strike any portion of the anvil roll 26. In other embodiments, the anvil surface 32 may be associated with one or more anvil inserts 34 which are adapted to coordinate with the outer surface 28 of the anvil roll 26 as representatively illustrated in FIG. 1. This arrangement allows the replacement of worn inserts 34 without replacing the remainder of the anvil roll 26. Furthermore, anvil inserts 34 allow for specialty materials to be used as the anvil surface 32 that may be too costly to use for the entire outer surface 28.

In various embodiments, the knife roll axis 22 may be parallel to the anvil roll axis 30. In some embodiments, the knife roll axis 22 may be non-parallel to the anvil roll axis 30. In some embodiments, the knife roll axis 22 and/or the anvil roll axis 30 may be parallel or non-parallel with the cross-machine direction 16. As illustrated in FIG. 1, the knife roll axis 22 is parallel with the anvil roll axis 30 and parallel with the cross-machine direction 16. In other words, the knife roll axis 22 and the anvil roll axis 30 are both perpendicular to the machine direction 14.

The perforation apparatus 12 also includes a cutting nip 36. The cutting nip 36 has a nip gap measured at the point wherein the cutting edge 24 of the knife roll 18 passes in closest proximity to the anvil surface 32 of the anvil roll 26. The nip gap may be any suitable distance based on the composition of the web 10 being perforated. In various embodiments, there may be no nip gap and the cutting edge 24 of the knife roll 18 may contact the anvil surface 32 of the anvil roll 26 with varying degrees of interference. For example, the cutting edge 24 may contact the anvil surface 32 with at least 0.001 inch, at least 0.002 inch, at least 0.003 inch, at least 0.004 inch, at least 0.005 inch, or at least 0.006 inch of interference.

Figure 2:
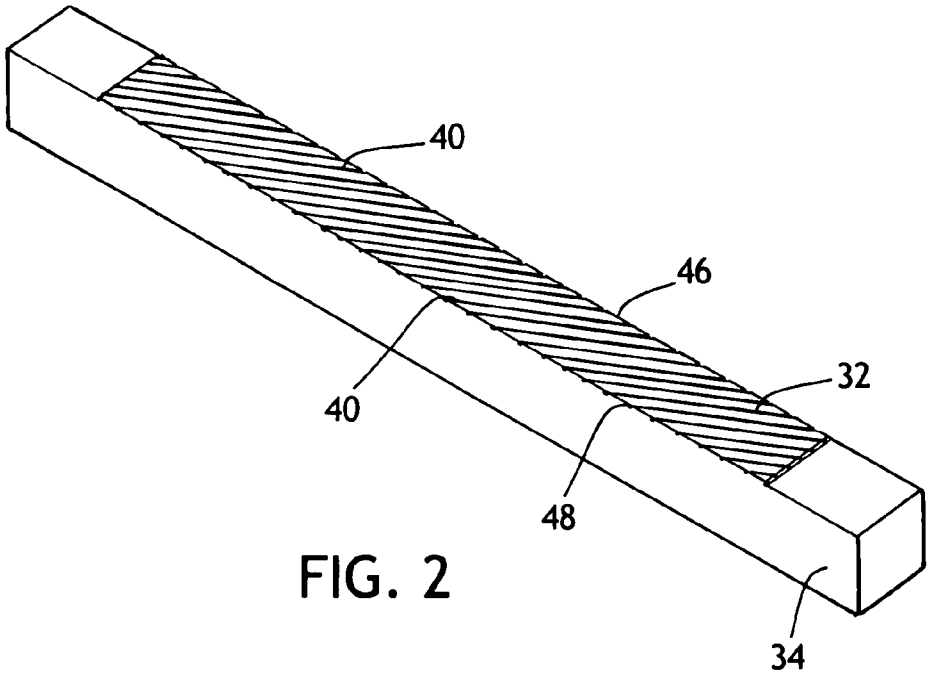
FIG. 2 representatively illustrates a perspective view of an exemplary embodiment of an anvil surface of the present invention.
Figure 3:
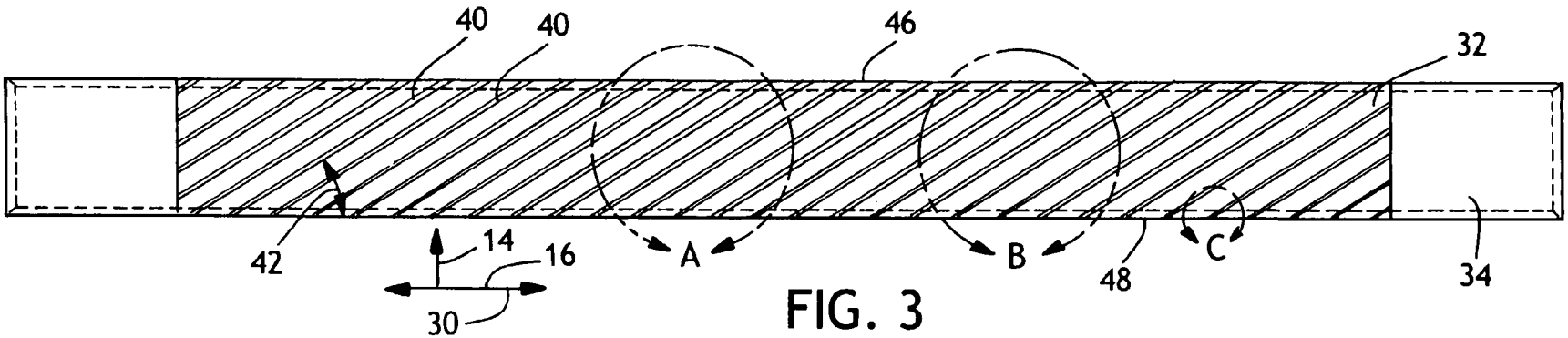
FIG. 3 representatively illustrates a top view of the anvil surface of FIG. 2.
Figure 4:
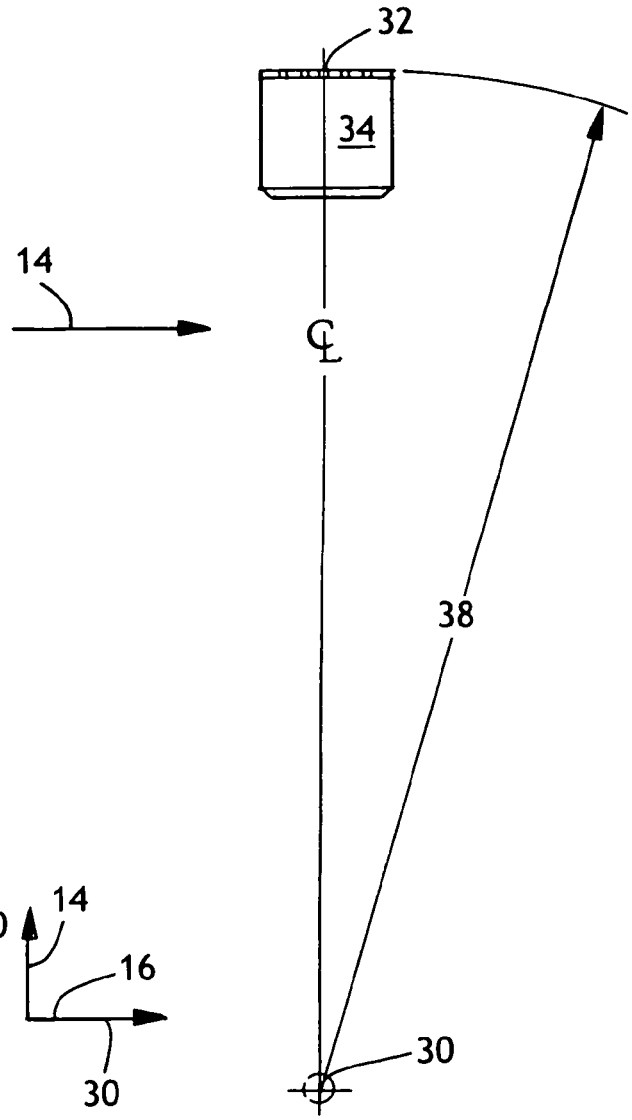
FIG. 4 representatively illustrates an end view of the anvil insert of FIG. 2.

Referring now to FIG. 2, the anvil insert 34 of FIG. 1 is illustrated in a perspective view. FIG. 3 representatively illustrates an enlarged top view of the anvil insert 34 of FIG. 2. FIG. 4 representatively illustrates an end view of the anvil insert 34 of FIG. 2. While characteristics of the anvil surface 32 are illustrated herein as part of an anvil insert 34, one skilled in the art will readily appreciate that the characteristics of the anvil surface 32, as discussed herein, are equally applicable to anvil surfaces 32 that form an integral part of the outer surface 28 of the anvil roll 26 and combinations of integral anvil surfaces and inserts.

The anvil surface 32 of the present invention may be made of any suitable material or combinations of materials. For example, the anvil surface 32 may be made from any suitable metal, alloy, ceramic, or the like, or combinations thereof. In some embodiments, the anvil surface 32 may include sintered alumina; silicon nitride; high speed specialty steel; high carbon steel; high chrome specialty steel; tungsten carbide; sub-micron tungsten/cobalt carbide, or the like, or combinations thereof. In some embodiments, the carbide may be Sinter HIP submicron ranging from 6% to 15% binder. In some embodiments, the binder may be nickel. In a particular embodiment, the anvil surface 32 may be made of 10% cobalt sub-micron HIP carbide.

In some embodiments, the anvil surface 32 may include one or more coating materials. For example, the anvil surface 32 may include titanium nitride coatings, Teflon brand coating, nickel coating, chrome plating, or the like, or combinations thereof. Suitable anvils and corresponding anvil surfaces are available from Everwear, Inc. having offices at 401 Stag Industry Blvd, Lake St. Louis, Mo., USA.

In some embodiments, the anvil surface 32 may have an anvil surface radius 38 in the machine direction 14 and measured relative to the anvil roll axis 30 as illustrated in FIG. 4. The anvil surface radius 38 may be any suitable dimension to coordinate with the surface radius of the anvil roll outer surface 28. For example, in some embodiments, the anvil surface radius 38 may be 2 to 24 inches.

Referring now to FIG. 3, the anvil insert 34 of FIG. 2 is illustrated in an enlarged top view. The anvil insert 34 has an anvil surface 32. The anvil surface 32 includes a plurality of grooves 40. In various embodiments, the grooves 40 may be parallel to the machine direction 14. In some embodiments, the grooves 40 may be angled relative to the anvil roll axis 30 and relative to the cross-machine direction 16 as illustrated in FIG. 3. As used herein, the term "angled" describes grooves 40 that form acute groove angles 42 of more than zero degrees and less than 90 degrees relative to the anvil roll axis 30 and relative to the cross-machine direction 16. In other words, the grooves 40 may form groove angles 42 that are not parallel with machine direction 14 and are not parallel with the cross-machine direction 16.

In various embodiments, the acute groove angles 42 formed by the grooves 40 may be 1 to 89 degrees, 10 to 75 degrees, or 20 to 50 degrees. In some embodiments, the acute groove angle 42 may be 25 to 45 degrees relative to the anvil roll axis of rotation 30 and/or the cross-machine direction 16. For example, as illustrated in FIG. 3, the grooves 40 are angled and form acute groove angles 42 of about 30 degrees relative to the cross-machine direction 16 and the anvil roll axis 30.

Figure 3A:
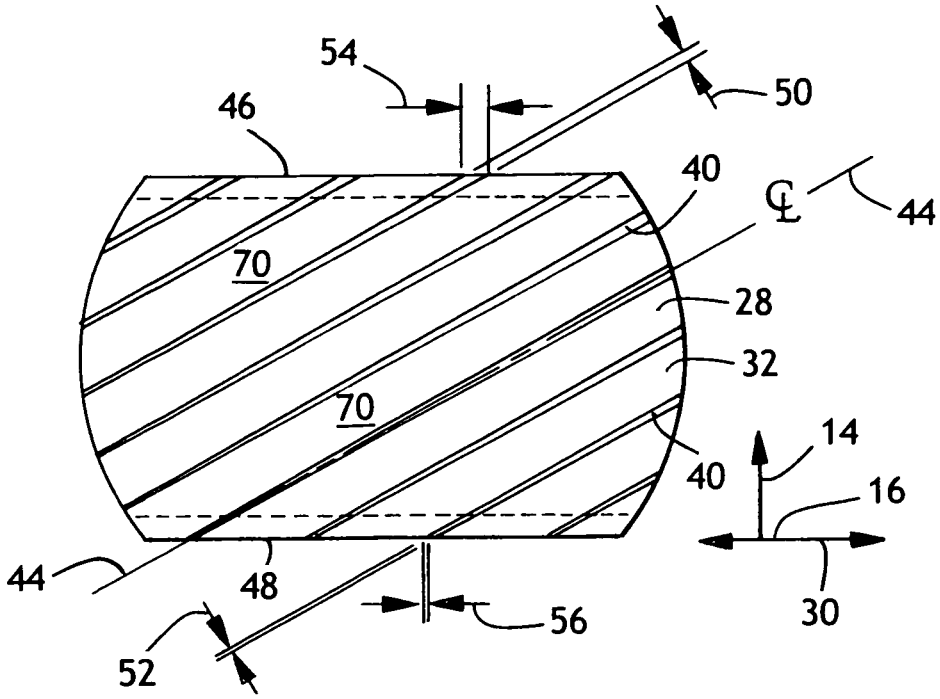
FIG. 3A representatively illustrates an expanded view of the detail A of FIG. 3.
Figure 3B:
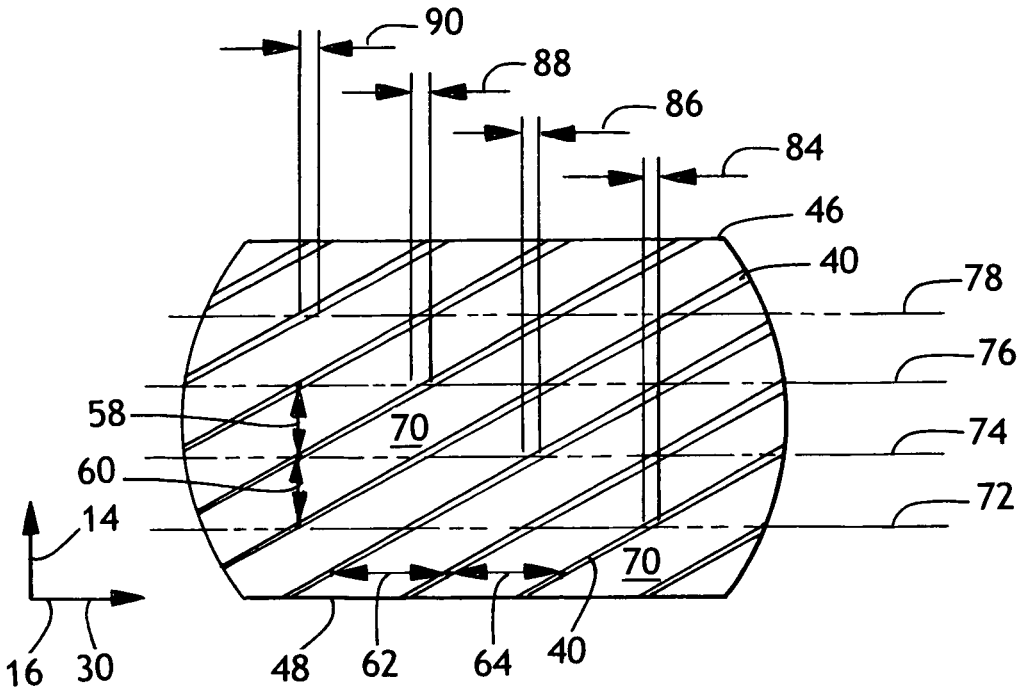
FIG. 3B representatively illustrates an expanded view of the detail B of FIG. 3.
Figure 3C:
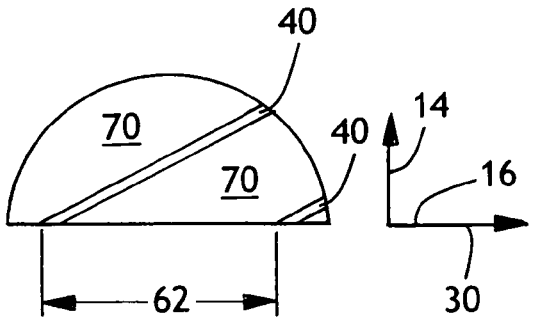
FIG. 3C representatively illustrates an expanded view of the detail C of FIG. 3.

In order to more clearly illustrate the details of the present invention, portions of the anvil surface 32 of FIG. 3 are designated as detail A, detail B, and detail C. FIG. 3A representatively illustrates an enlarged view of the portion of the anvil surface 32 designated as detail A. Likewise, FIGS. 3B and 3C representatively illustrate enlarged views of the portions of the anvil surface 32 designated as detail B and detail C respectively.

Referring now to FIG. 3A, the anvil surface 32 includes a plurality of grooves 40 having a plurality of groove centerlines 44. The anvil surface 32 may include a first edge 46 defining the transition, in the machine direction 14, from the anvil roll outer surface 28 to the anvil surface 32 (FIG. 1). The anvil surface 32 may also include a second edge 48 defining the transition, in the machine direction 14, from the anvil surface 32 to the anvil roll outer surface 28 (FIG. 1). In various embodiments, one or more of the grooves 40 may extend from the first edge 46 to the second edge 48. In some embodiments, one or more of the grooves 40 may stop short of the first edge 46 and/or the second edge 48.

The grooves 40 may have a first groove width 50 as measured at the portion of the groove 40 most proximate the first edge 46. The grooves 40 may have a second groove width 52 measured at the portion of the groove 40 most proximate the second edge 48. The first width 50 and the second width 52 are measured perpendicular to the groove centerline 44. In various embodiments, the first groove width 50 may be the same as the second groove width 52 or may be different. As illustrated in FIG. 3A, the first groove width 50 is greater than the second groove width 52 thereby creating tapered grooves 40.

The grooves 40 may also have a first cross-machine direction (CD) width 54, as measured in the cross-machine direction 16, at the portion of the groove 40 most proximate the first edge 46. Likewise, the grooves 40 may have a second cross-machine direction (CD) width 56, as measured in the cross-machine direction 16, at the portion of the groove 40 most proximate the second edge 48. In various embodiments, the first CD width 54 may be the same as the second CD width 56 or may be different. As illustrated in FIG. 3A, the first CD width 54 is greater than the second CD width 56.

In some embodiments, the groove width and/or groove CD width may be variable. As used herein, the term "variable" describes a groove 40 having a centerline 44 wherein the width of the groove at a first location is different than the width of the groove at a second location as measured perpendicularly to the centerline 44. For example, the grooves 40 of FIG. 3A are variable. Specifically, the grooves 40 are illustrated as having a straight taper with the wider end at the first edge 46 and the narrower end at the second edge 48. In some embodiments, the groove width tapers from about 0.0150 inches to about 0.0060 inches. One skilled in the art will readily appreciate that the taper could have any suitable size and rate of divergence and/or convergence. Furthermore, one skilled in the art will readily appreciate that the taper could easily be reversed such that the wider end of the taper was proximate the second edge 48 and the narrower end of the taper was proximate the first edge 46. In embodiments wherein the grooves 40 have a variable width, the groove angle 42 is measured with reference to the centerline 44.

In various embodiments, the grooves 40 may have any suitable machine direction spacing. In some embodiments, the grooves 40 may have a first groove spacing 58 and a second groove spacing 60 as measured in the machine direction 14. The first groove spacing 58 and the second groove spacing 60 may be the same or different (i.e., variable machine direction groove spacing). For example, as illustrated in FIG. 3B, the first groove spacing 58 is the same as the second groove spacing 60. In various embodiments, the machine direction groove spacing may be any suitable distance. For example, in some embodiments, the grooves 40 may all be spaced apart by about 0.1 inches as measured in the machine direction 14.

In various embodiments, the grooves 40 may have any suitable cross-machine direction spacing. In some embodiments, the grooves 40 may have a first groove spacing 62, as measured in the cross-machine direction 16, as illustrated in FIG. 3C. The grooves 40 have a second groove spacing 64, as measured in the cross-machine direction 16 and illustrated in FIG. 3B. The first groove spacing 62 and the second groove spacing 64 may be the same or may be different (i.e., variable CD groove spacing). For example, as illustrated in FIG. 3B, the first groove spacing 62 is the same as the second groove spacing 64. In various embodiments, the groove spacing may be any suitable distance. For example, in some embodiments, the grooves may all be spaced apart by about 0.16 inches as measured in the cross-machine direction 16.

In various embodiments, one or more of the grooves 40 may have any suitable length, width, depth, cross-sectional shape, and/or groove angle. In various embodiments, one or more of the grooves may have a variable intra-groove (i.e., within a single groove) width, depth, cross-sectional shape, and/or groove angle. In some embodiments, the various grooves may have variable inter-groove (i.e., between two different grooves) spacing, length, width, depth, cross-sectional shape, and/or groove angle. For example, FIG. 3A illustrates a plurality of grooves 40 wherein each groove 40 has a variable intra-groove width. However, the grooves 40 of FIG. 3A are generally uniform from groove to groove (inter-groove).

In some embodiments, the majority of the grooves 40 have a variable intra-groove width. For example, in some embodiments, the majority of the grooves may have a straight edge taper as illustrated in FIGS. 3 and 3B. As a result of this taper, the grooves 40 may have various CD widths at various machine direction (MD) cutting positions. For example, as illustrated in FIG. 3B, the effective CD width of the grooves can be changed by changing the MD cutting position. Specifically, at a first MD cutting position 72 the grooves 40 may have a first CD width 84. At a second MD cutting position 74, the grooves 40 may have a second CD width 86 greater than the first CD width 84. Likewise, at a third MD cutting position 76, the grooves 40 may have a third CD width 88 greater than the second CD width 86. Finally, at a fourth MD cutting position 78, the grooves 40 may have a fourth CD width 90 greater than the third CD width 88. One skilled in the art will readily appreciate that any number of MD cutting positions may be chosen to achieve the corresponding CD width that is desired. One skilled in the art will also appreciate that increasing the rate of taper of the groove will increase the rate of change of CD groove width associated with each MD cutting position change.

The perforation apparatus of claim 10 may include any suitable cutting edge 24. While the cutting edge 24 is illustrated herein as a rotary cutter, those skilled in the art will readily appreciate that reciprocating die cutters or any other suitable cutters could also be utilized. Furthermore, while the cutting edge 24 is illustrated herein as a pinch cutter, any suitable cutting mechanism or combination, such as a shear cutter, is also contemplated. In various embodiments, the cutting edge 24 may be made of any suitable material. For example, the cutting edge 24 may be made from any suitable metal, alloy, ceramic, or the like, or combinations thereof.

In some embodiments, the cutting edge 24 may include sintered alumina; silicon nitride; high speed specialty steel; high carbon, high chrome specialty steel; tungsten carbide; submicron tungsten/cobalt carbide, or the like, or combinations thereof. In some embodiments, the carbide may be Sinter HIP submicron ranging from 6% to 15% binder. In some embodiments, a nickel binder may also be suitable. In some embodiments the cutting edge 24 may include a submicron carbide insert and a stainless steel body.

In some embodiments, the cutting edge 24 may include one or more coating materials. For example, the cutting edge 24 may include titanium nitride coatings, Teflon brand coating, nickel coating, chrome plating, or the like, or combinations thereof. Suitable knives having suitable cutting edges 24 are available from Everwear, Inc. having offices at 401 Stag Industry Blvd, Lake St. Louis, Mo., USA.

In various embodiments, the cutting edge 24 may be notched or may be continuous. As used herein, the term "continuous" is used to define a cutting edge having no nicks, gaps, spaces, notches or the like greater than 1 mm wide by 1 mm deep.

Referring again to FIG. 1, the apparatus 12 described herein is suitably used as part of a method for perforating a web 10. The method may include providing the web 10, passing the web 10 through the apparatus 12 in the machine direction 14 to create perforations 11. The apparatus 12 includes an anvil roll 26 which includes an anvil surface 32. The anvil roll 26 is adapted to rotate about the anvil roll axis 30 in the direction indicated by arrow 66. The anvil surface 32 may include a plurality of grooves 40 separated by a plurality of lands 70. In some embodiments, the grooves 40 may be parallel with the machine direction 14. In some embodiments, the grooves 40 may form acute groove angles 42 of more than zero degrees and less than 90 degrees relative to the cross-machine direction 14 and the anvil roll axis 30 as described herein. In various embodiments, the grooves 40 may have a variable groove width as described herein.

Figure 5:
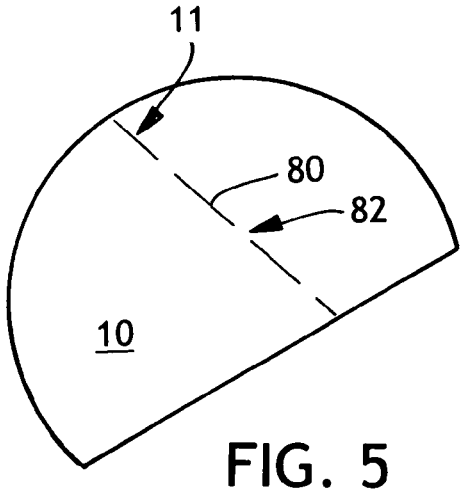
FIG. 5 representatively illustrates an expanded view of the detail D of FIG. 1.

The apparatus 12 may further include a knife roll 18 which includes a cutting edge 24. The knife roll 18 is adapted to rotate about the knife roll axis 22 in the direction indicated by arrow 68. The method includes perforating the web 10 in a cutting nip 36 defined by the point wherein the cutting edge 24 contacts or comes into closest proximity to the anvil surface 32. The web 10 is pressed between the cutting edge 24 and the anvil surface 32 in the cutting nip 35 to create perforations 11 in the web 10. The perforations 11 include a plurality of connectors 82 separated by a plurality of slits 80 as representatively illustrated in FIG. 5. FIG. 5 is an enlarged view of the detail D of FIG. 1.

Referring now to FIG. 3B, in various embodiments, the method may include contacting the cutting edge 24 against the anvil surface 32 at a first machine direction cutting position 72 which corresponds to a first CD groove width 84. The pressure of the cutting edge 24 against the anvil surface 32 cuts the web 10 at the lands 70 resulting in slits 80 and maintains the web 10 at the grooves 40 resulting in connectors 82 as illustrated in FIG. 5.

In various embodiments, the method may further include phasing the apparatus 12 so as to contact the cutting edge 24 against the anvil surface 32 at a second machine direction cutting position 74. Creating the perforation 11 at the second machine direction cutting position 74 results in smaller slits 80 and larger connectors 82 due to the increased CD groove width 86 which in turn is due to the variable width of the grooves 40. Likewise, in various embodiments, the relative size of the connectors 82 and the slits 80 can be altered by phasing the apparatus 12 so as to contact the cutting edge 24 against the anvil surface 32 at a third and fourth machine direction cutting positions 76 and 78 to effectively alter the CD groove widths 88 and 90 respectively. Although four different positions are illustrated, one skilled in the art will readily appreciate that any suitable number of positions are possible.

The CD groove widths 84, 86, 88, and 90 may be any suitable size depending on the application. In some embodiments, the CD groove widths 84-90 may range from about 0.0015 inches to about 0.030 inches. In a specific embodiment, the CD groove width 84 may be about 0.015 inches, the CD groove width 86 may be about 0.019 inches, the CD groove width 88 may be about 0.023 inches, and the CD groove width 90 may be about 0.27 inches.

In various embodiments, the method and apparatus may be used with any suitable web 10. The web 10 may be made of any suitable material or combination of materials. For example, the web 10 may include woven materials, nonwoven materials, films, mesh, scrim, reinforcement strands, and the like, and combinations thereof. The web 10 may be a single layer of material or the web 10 may be a laminate material including two or more layers. The various layers may be coextensive in width or one layer may be wider or narrower than another. The web 10 may further include one or more discrete pieces of material. In some embodiments, the web 10 may include at least one strand of elastic material, reinforcement material, or the like. In some embodiments, the web 10 may include at least one carrier material 92 and a plurality of elastic strands 94 extending in the machine direction 14. In these embodiments, the method may further include perforating the web 10 by cutting or damaging one or more of the strands of elastic 94 and maintaining portions of the carrier 92 as the connectors 82.

In some embodiments, the web 10 may be a laminate material. The laminate may include a carrier layer made of a nonwoven material or a tissue. The nonwoven material may be a spunbond-meltblown-spunbond laminate. The carrier layer may include a 1, 2, 3, 4, 5, 6, 7, or more elastics extending in the machine direction. The carrier layer may be folded around the elastic strands which may be adhesively encapsulated therein. The elastic strands may have a diameter of about 0.005 to about 0.030 inches. In some embodiments, the elastic strands may have an average diameter of about 0.009 inches to about 0.020 inches.

In embodiments wherein the grooves 40 are angled, the elastic strands 94 running in the machine direction 14 cannot align perfectly with the grooves 40. In some embodiments, the elastic strands 94 may be aligned with the lands 70 in the cutting nip 36 such than the elastic strands 94 are cut during perforation. In other embodiments wherein the cutting edge 24 contacts the elastic strand 94 directly over a groove 40, the elastic strand 94 will be forced over a leading edge 96 and a trailing edge 98 of the groove 40 as illustrated in FIG. 6.

Figure 6:
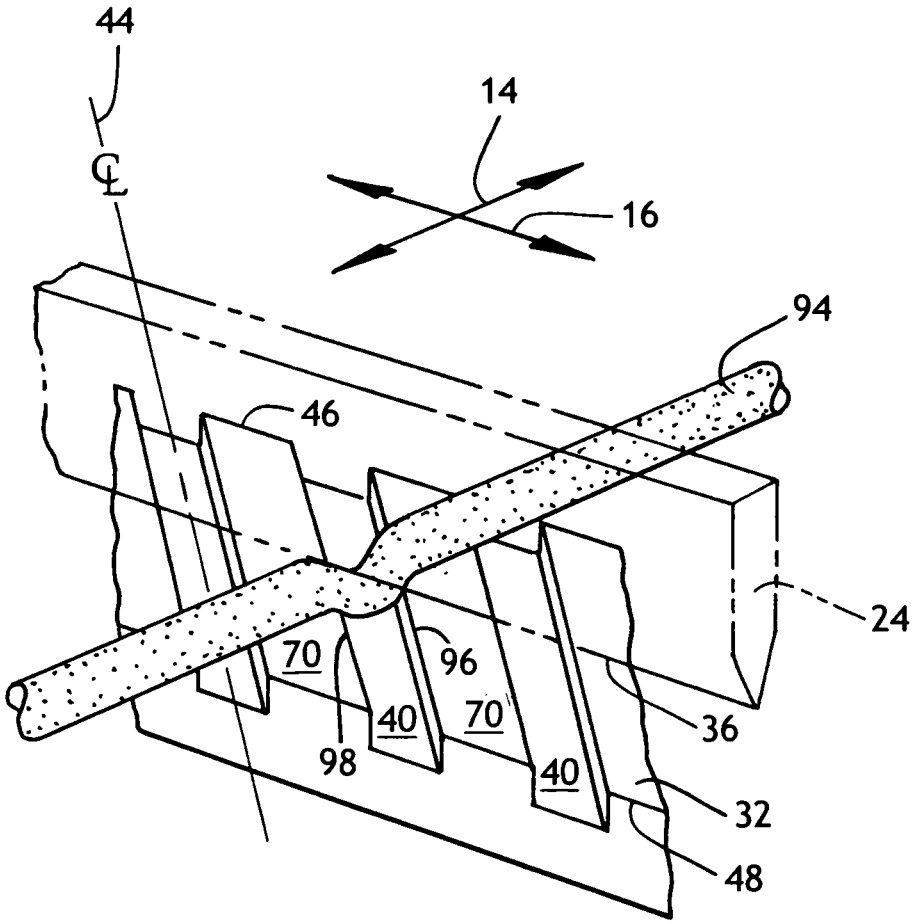
FIG. 6 representatively illustrates a perspective view of an exemplary embodiment of the present invention.

FIG. 6 representatively illustrates an enlarged view of an exemplary embodiment of the present invention. FIG. 6 illustrates an elastic strand 94 extending in the machine direction 14 across an anvil surface 32. The anvil surface 32 includes grooves 40 which are angled. A cutting edge 24 is shown in phantom to better illustrate the groove. The cutting edge contacts the anvil surface 32 to define a cutting nip 36. The web is removed to better illustrate the apparatus. FIG. 6 illustrates the situation wherein the elastic strand 94 aligns over a groove 40 in the cutting nip 36. In these situations, it is believed that the elastic strand 94 is pressed over a leading edge 96 and a trailing edge 98 of the groove 40 as the cutting edge 24 presses a portion of the elastic strand 94 into the groove 40. Thus, even if the elastic strand 94 is not cut completely, the elastic strand 94 is pinched against the leading edge 96 and the trailing edge 98 and is believed to be sufficiently damaged to minimize the impact on the method. In other words, the angled grooves 40 minimize the likelihood that the elastic strands 94 perfectly align with a groove 40 and thereby avoid being, at least partially, cut or damaged between the cutting edge 24 and the anvil surface 32.

While the invention has been described in detail with respect to specific embodiments thereof, it will be appreciated that those skilled in the art, upon attaining understanding of the foregoing will readily appreciate alterations to, variations of, and equivalents to these embodiments. Accordingly, the scope of the present invention should be assessed as that of the appended claims and any equivalents thereto. Additionally, all combinations and/or sub-combinations of the disclosed embodiments, ranges, examples, and alternatives are also contemplated.

The invention claimed is:

1. A method of perforating a web comprising, providing a web, passing the web through a nip, wherein the nip is defined as a contact point between a cutting edge and an anvil surface, the cutting edge comprising a portion of a knife roll and the anvil surface comprising a portion of an anvil roll, the anvil roll being adapted to rotate about an anvil roll axis, the knife roll being adapted to rotate about a knife roll axis, the anvil surface comprising a plurality of grooves separated by a plurality of lands, the plurality of grooves being angled and having variable groove widths, perforating the web in the nip at a first machine direction cutting position by pressing the cutting edge against the web and the anvil surface to cut the web at the lands and to maintain the web at the grooves, and phasing the cutting edge relative to the anvil surface to perforate the web at a second machine direction cutting position wherein the grooves have a first width at the first machine direction cutting position and have a different second width at the second machine direction cutting position.

2. A method of perforating a web comprising, providing a web, passing the web through a nip, wherein the nip is defined as a contact point between a cutting edge and an anvil surface, the cutting edge comprising a portion of a knife roll and the anvil surface comprising a portion of an anvil roll, the anvil roll being adapted to rotate about an anvil roll axis, the knife roll being adapted to rotate about a knife roll axis, the anvil surface comprising a plurality of grooves separated by a plurality of lands, the plurality of grooves being angled and having variable groove widths, and perforating the web in the nip at a first machine direction cutting position by pressing the cutting edge against the web and the anvil surface to cut the web at the lands and to maintain the web at the grooves.

3. The method of claim 2 wherein the web comprises a carrier and a plurality of elastic strands extending in a machine direction and the method further includes perforating the web in a cross-machine direction by cutting or damaging all the strands of elastic and maintaining portions of the carrier as connectors.

4. The method of claim 3 wherein the elastic strands are aligned over the lands in the nip.

5. An anvil roll comprising an anvil surface wherein the anvil surface includes a plurality of angled grooves having a variable cross-machine direction groove width, wherein the anvil surface is part of an insert and wherein the anvil surface is made of cobalt sub-micron HIP carbide and wherein the grooves have a groove angle of about 25 degrees to 45 degrees.

6. The anvil roll of claim 5 wherein the anvil surface has a radius in the machine direction of 6 to 12 inches.

7. The anvil roll of claim 5 wherein the cross-machine direction groove width varies from about 0.015 inches to about 0.006 inches.

8. The anvil roll of claim 5 wherein the grooves are spaced apart by about 0.1 inches as measured in the machine direction.

9. The anvil roll of claim 5 wherein the grooves are spaced apart by about 0.160 inches as measured in the cross machine direction.

10. The anvil roll of claim 5 wherein a majority of the grooves have a straight edge taper.

11. A perforation apparatus comprising, a knife roll adapted to be rotated about a knife roll axis, the knife roll comprising at least one cutting edge;

an anvil roll adapted to be rotated about an anvil roll axis, the anvil roll axis being parallel with the knife roll axis, the anvil roll having an outer surface wherein at least a portion of the outer surface defines an anvil surface which includes a plurality of angled grooves, wherein a majority of the grooves have a variable groove width, and a cutting nip defined by the point wherein the cutting edge contacts the anvil surface.

12. The perforation apparatus of claim 11 wherein the cutting edge is continuous.

13. The perforation apparatus of claim 11 wherein the cutting edge is aligned parallel with the knife roll axis.

14. The perforation apparatus of claim 11 wherein the majority of the grooves have a straight edge taper.

* * * * *